US005494119A

United States Patent [19]

Tully

[11] Patent Number: 5,494,119

[45] Date of Patent: Feb. 27, 1996

[54] CORE SAMPLING DEVICE

[76] Inventor: Francis X. Tully, R.R. 2, Box 2, Thompson, Pa. 18465

[21] Appl. No.: 273,719

[22] Filed: Jul. 12, 1994

[51] Int. Cl.[6] ..... E21B 49/00

[52] U.S. Cl. ..... 175/58; 175/244; 175/293; 175/418

[58] Field of Search ..... 175/58, 244, 293, 175/405, 418; 173/206

[56] References Cited

U.S. PATENT DOCUMENTS

| | | | |
|---|---|---|---|
| 2,880,969 | 7/1959 | Williams | 255/72 |
| 3,324,958 | 7/1967 | Clark | 175/84 |
| 3,438,452 | 4/1969 | Bernard et al. | 175/6 |
| 3,517,754 | 6/1970 | Hughes | 173/104 |
| 3,524,511 | 8/1970 | Klemm | 175/92 |
| 3,631,934 | 1/1972 | da Rocha | 175/58 |
| 3,860,272 | 1/1975 | Becker | 285/133 A |
| 3,941,196 | 3/1976 | Curington et al. | 175/215 X |
| 4,084,646 | 4/1978 | Kurt | 173/17 |
| 4,141,153 | 2/1979 | Nelson | 33/286 |
| 4,518,051 | 5/1985 | Sollie et al. | 175/250 |
| 4,588,036 | 5/1986 | Deserochers et al. | 175/247 X |
| 4,598,777 | 7/1986 | Park et al. | 175/58 |
| 4,729,437 | 3/1988 | Zapico | 175/20 |
| 4,946,000 | 8/1990 | Gibson et al. | 175/251 |
| 5,343,771 | 9/1994 | Turriff et al. | 175/20 X |

OTHER PUBLICATIONS

"Soil Sampling Tools" —catalogue p. 3, undated (acknowledged to be prior art).

Ingersoll—Rand catalogue "The Hole Story of Downhole Drilling" ©1979, pp. 1–12.

*Primary Examiner*—Roger Schoeppel

*Attorney, Agent, or Firm*—Synnestvedt & Lecnher

[57] ABSTRACT

The obtaining of undisturbed core samples of subsurface soils for analysis and study is disclosed. Percussion-type downhole drilling equipment uses compressed air directed internally of a pipe casing to actuate a percussion-type piston adjacent the bottom of a hole being drilled. A tubular adapter is mounted in a chuck at the lower end of a casing and house the piston and the adapter for rotation and for longitudinal movement relatively thereto. The adapter has a striking face interfacing with the piston and has its opposite end provided with pipe threads for connection of an open-ended core sampler which is preferably of the split-spoon type. The adapter is provided with ports at a location spaced axially away from the core sampler for exhaust air released by the percussion means during a power stroke upwardly and thus away from the core sampler. The adapter acts much like the head of a nail driving the core sampler into the earth formation to be sampled producing an uncontaminated earth sample undisturbed by the exhaust air. Once the sample has been obtained, the apparatus with adapter is withdrawn from the hole. The process may be repeated or the core sampler replaced by a standard downhole drill bit if further drilling is required.

4 Claims, 3 Drawing Sheets

CORE SAMPLING DEVICE

FIELD OF THE INVENTION

This invention relates to core sampling and more particularly to the obtaining of undisturbed soil samples at the bottom of a bore hole utilizing percussion-type downhole drilling equipment.

BACKGROUND OF THE INVENTION

The obtaining of undisturbed core samples has become increasingly wide spread for purposes such as the monitoring of well sites and for plotting the boundaries of contaminated ground in preparation for the clean up of environmental spills or in drilling for oil, natural gas or various minerals when samples of the material of a formation which is being drilled are needed.

The accepted means of acquiring a soil sample has been to slip a core barrel into the hollow part of a hollow-stem auger drill after the auger drill has drilled into the sampling area. In capturing a sample with this method, the virgin soil is greatly disturbed before the core barrel can be introduced into the sampling area.

The invention involves use of so called downhole percussion drilling techniques and apparatus used extensively for hard rock drilling and where relatively straight holes are required. As described in U.S. Pat. Nos. 3,517,754 and 4,084,646, in downhole drilling, the drill constitutes a compressed air actuated piston which comprises a percussion device which follows the drill bit down the hole being drilled. Air under pressure delivered from a compressor on the drilling rig is directed downwardly through the drill steel and channelled so that it initially and rapidly moves the piston upwardly away from the drill bit. When the piston is at the top of its stroke, air delivery passages are opened admitting the compressed air above the piston and uncovering an exhaust passage which allows a path for air to be exhausted out of an opening in the face of the drill bit. The power of the expanded compressed air is released upon opening of the exhaust passage forcing the piston rapidly downwardly onto a striking face of the drill bit. The impact of the piston against the drill bit drives the bit into the rock surface underlying the bit. The exhaust air then travels upwardly carrying broken rock out of the hole being drilled. Using equipment of the type described, holes can be drilled having a diameter of up to about 30". Smaller sized drill bits are utilized for drilling of wells, mining and the like. The larger sized holes offer a cost efficient mechanism for drilling of holes for footings, elevator shafts and conduits.

SUMMARY AND OBJECTS OF THE INVENTION

The invention has as an objective the obtaining of undisturbed core samples for analysis and study and not only facilitates sampling from shallow holes, but is of particular applicability to the obtaining of samples from sites which are a relatively large distance below the earth's surface. The invention is intended to eliminate the disturbance of the sample caused by conventional auger equipment and has applicability not only to sampling carried out on dry land but also beneath the ocean floor.

In its preferred form, the invention involves the use of percussion-type downhole drilling equipment wherein compressed air is directed internally of a pipe casing to actuate a percussion-type piston adjacent the bottom of a hole being drilled. The invention provides a tubular adapter mounted at the lower end of the casing, housing the piston for rotation with the piston and its casing and for longitudinal movement relatively thereto. The adapter has a striking face interfacing with the piston and means spaced axially of the striking face for connection of an open ended core sampler which is preferably of the split-spoon type. The adapter is provided with portage at a location spaced axially away from the core sampler for directing exhaust air released by the percussion means during a power stroke so as to direct the exhaust air upwardly and thus away from the core sampler. The adapter acts much like the head of a nail driving the core sampler into the earth formation to be sampled producing an uncontaminated earth sample undisturbed by the exhaust air. Once the sample has been obtained, the apparatus is withdrawn from the hole and the adapter. The process may be repeated or the core sampler replaced by a standard downhole drill bit if further drilling is required.

An important advantage of the invention is the use of a single rig for drilling and core sampling.

DETAILED DESCRIPTION OF THE ILLUSTRATIVE EMBODIMENT OF THE INVENTION

Figure 1:
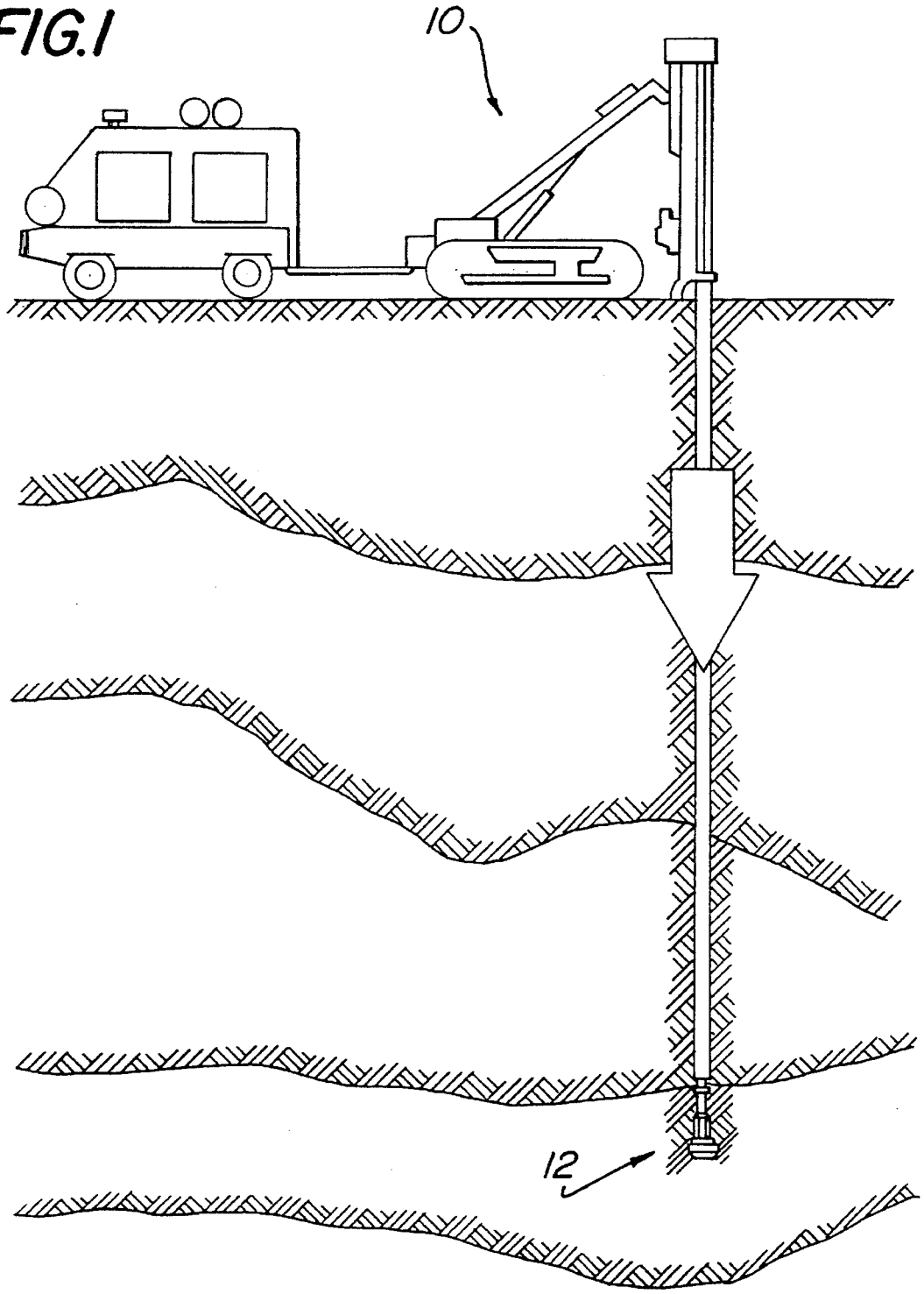
FIG. 1 shows a drilling rig utilized for both downhole drilling and for obtaining core samples in accordance with the techniques of the present invention.

FIG. 1 shows, in schematic form, a drilling rig 10 of the crawler type operating a downhole drill 12 of substantially conventional form.

Figure 2:
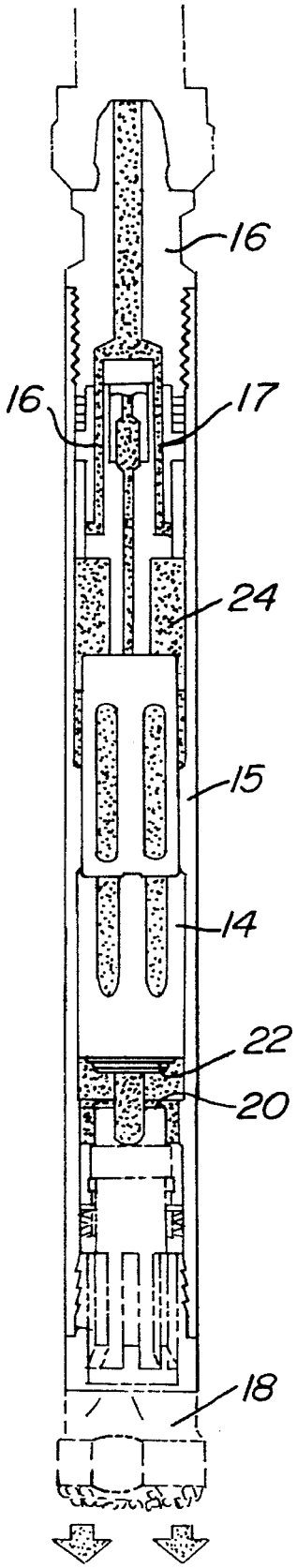
FIG. 2 is a sectional view showing, in detail, portions of the downhole drill of FIG. 1.

The principals of operation of the downhole drill can be seen from FIGS. 1 and 2. The drilling apparatus, as shown more particularly in U.S. Pat. Nos. 3,517,754 and 4,084,646, includes a piston 14 mounted within a casing 15. A backhead 16 is threaded into the upper end of the casing and is provided with an axial bore through which compressed air is delivered from a compressor on the drilling ring, through the drill steel, not illustrated. The piston is supplied with compressed air through a system of passages 17 located internally of casing 15. In a drilling operation, a bit 18 is threadedly secured beneath piston 14. The upper end of drill bit 18 comprises a striking face 20 which is disposed beneath a corresponding face 22 on piston 14. In use, compressed air supplied through passages 17 is delivered to the underside of the piston raising the piston upwardly within chamber 24. As the piston reaches its upper limit of travel, an exhaust passage which extends through the bit 18 is opened and the compressed air above the piston drives the piston sharply downwardly so it impacts on the striking face 20 of the drill bit 18. The drill bit fractures the rock which is at the bottom of the hole and the exhaust air carries the broken rock upwardly in the space surrounding the casing 15 of the downhole drill. Means located on the drill rig rotate the assembly during each cycle of the drilling operation.

Figure 3:
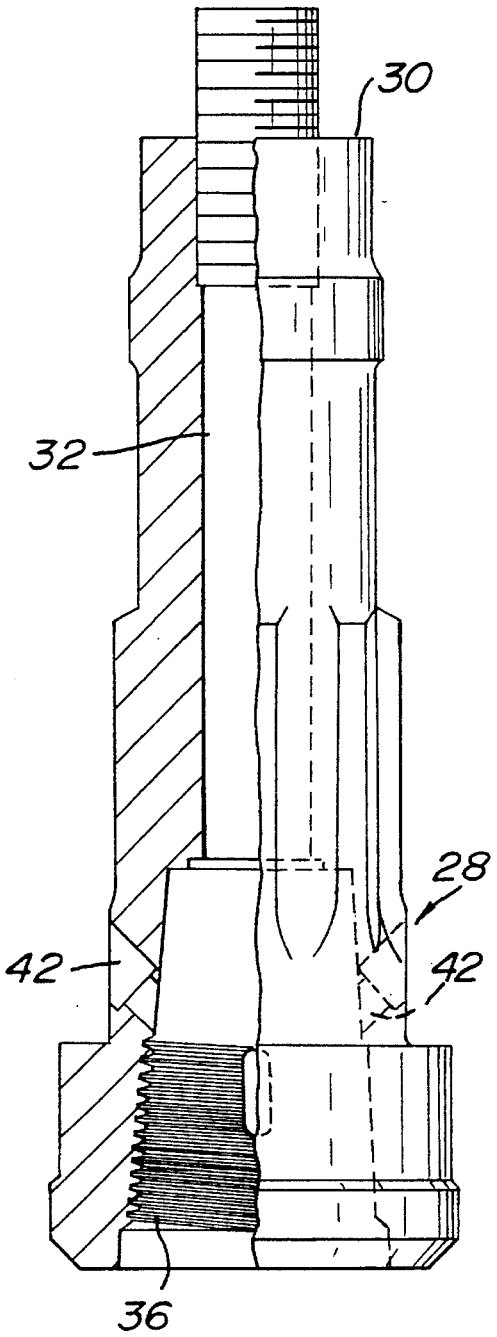
FIG. 3 is a side view, with portions broken away, of an adapter of the present invention.

In carrying out the invention, I provide an adapter element 28, illustrated in FIG. 3 which serves as a replacement for drill bit 18. Adapter element 28 has an exterior configuration which is substantially identical to drill bit 18 and fits within casing 15 for both axial relative movement and rotational movement with the piston. The upper end of adapter 28 constitutes a striking face 30. The adapter is provided with an axial bore 32 which extends lengthwise thereof. The lower end of the bore 32 is tapered, as shown at 34, and is provided with connecting means for connection to a sampling device to be described hereinafter.

The preferred form of fastening means constitutes standard API pipe threading, as can be seen at 36. A plurality of ports 42 extend from bore 32 angularly upwardly through the adapter side wall and provide for the exit of exhaust air when the piston 14 moves downwardly during the impact stroke.

Figure 4:
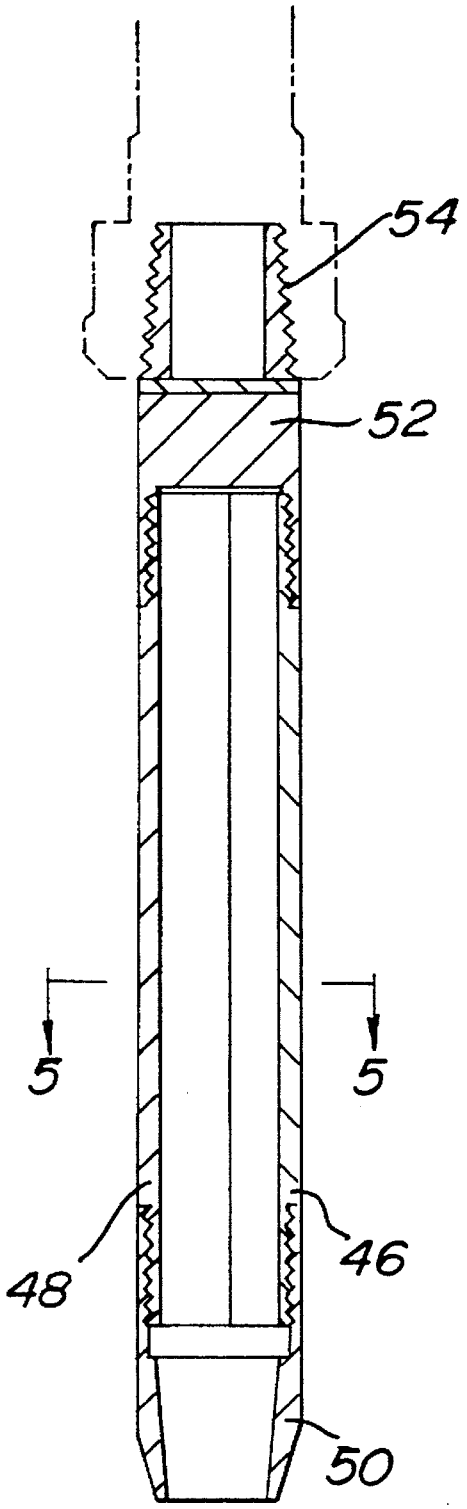
FIG. 4 shows a core sampler mounted in the adapter of FIG. 3 in a typical installation involving use of a downhole impact drilling device.
Figure 5:
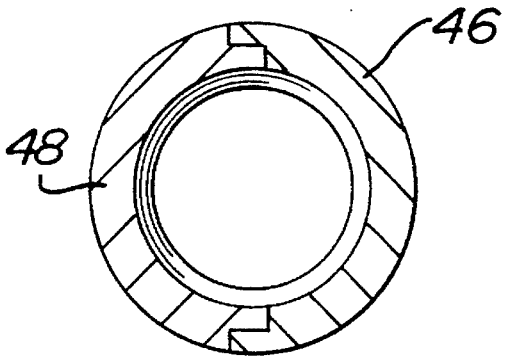
FIG. 5 is a sectional view taken on line 5—5 of FIG. 4.

A standard split-spoon sampler for the taking of samples from the bottom of a bore hole is illustrated in FIGS. 4 and 5. The sampler includes a pair of identically shaped split-tube members 46 and 48 (see FIG. 5) which are threaded at each end and held together by a header member 50 and a drive shoe 52. The header member 52 is externally threaded, as shown at 54, for threaded connection with the threads 36 in the tapered opening in the base of the adapter 28. The interior of the sampler may be provided with a suitable liner to facilitate carrying samples to a field office for analysis.

In use, the standard bit illustrated in FIG. 2 is removed and replaced with adapter 28. The split-spoon core barrel sampler is threadedly secured in the end of the adapter. The sampler is driven into the bottom of the hole by the delivery of compressed air to the piston 14 in the manner explained above. Exhaust air released as the piston commences its downward stroke flows through the adapter to the exhaust ports 42 where it is directed upwardly and away from the sampler. The process is repeated through the use of the sampler and undisturbed samples can be readily obtained since the hole is already cleaned when sampling is commenced and since the compressed air is diverted in a manner which avoids disturbing the sample. When the sampler has been driven an amount equivalent to the length of the core barrel, the sampler is then pulled out of the hole and the core and barrel removed. Another core barrel sampler may then be put in place if it is desired that sampling continue or the core barrel sampler replaced with a drill bit for further drilling.

I claim:

1. In percussion-type downhole drilling equipment wherein compressed air directed internally of a drill pipe casing actuates percussion means adjacent the bottom of the hole, means for obtaining undisturbed core samples of subsurface soils comprising:

a split-spoon core sampler, a tubular adapter comprising a tubular body having upper and lower end portions, said tubular body defining an internal passage for compressed air exhausted by said percussion means, said adapter having a striking face adjacent the upper end interfacing with said percussion means, said adapter lower end having connector means adjacent thereto for interconnection of the adapter with said split-spoon core sampler, said split-spoon core sampler having a downwardly facing open end, an upwardly and outwardly inclining port extending through the tubular body of said tubular adapter from said internal passage for directing exhaust air released by said percussion means upon completion of a power stroke in a direction extended upwardly away from said split-spoon core sampler.

2. Percussion type drilling equipment according to claim 1, wherein said adapter has an enlarged end portion disposed oppositely to said striking face, said port is located within said enlarged end portion.

3. Percussion type drilling equipment according to claim 2, wherein said core sampler is threadedly secured to said adapter.

4. A method of core sampling which comprises disposing a percussion means within a string of drill pipe adjacent the bottom of a hole, directing compressed air downwardly through said string of pipe to actuate said percussion means, disposing a tubular member internally of said pipe beneath said percussion means, said tubular member having a surface interfacing with said percussion means and having a connector for a core sampler disposed therebeneath, activating said percussion means by the application of a charge of compressed air thereto, and directing the exhaust air upwardly and outwardly away from the core sampler through parting disposed in the tubular member, whereby core material within the sampler is undisturbed by said exhaust air.

* * * * *